United States Patent [19]

Kupersmit

[11] Patent Number: 4,946,091

[45] Date of Patent: Aug. 7, 1990

[54] COLLAPSIBLE CONTAINER HAVING CONGRUENT DOOR RETAINING MEANS

[76] Inventor: Julius B. Kupersmit, 145-80 228th St., Springfield Gardens, N.Y. 11413

[21] Appl. No.: 409,767

[22] Filed: Sep. 20, 1989

[51] Int. Cl.[5] ..... B65D 88/54

[52] U.S. Cl. ..... 229/122.1; 220/441; 229/23 R; 229/125; 229/125.37

[58] Field of Search ..... 229/23 R, 122, 122.1, 229/125, 125.37; 220/441; 222/153, 528, 532

[56] References Cited

U.S. PATENT DOCUMENTS

| | | | |
|---|---|---|---|
| 2,799,440 | 7/1957 | Frederich et al. | 229/122.1 |
| 3,193,152 | 7/1965 | White, Jr. | 229/125.37 |
| 3,550,837 | 12/1970 | Erb | 229/125.37 |
| 3,957,179 | 5/1976 | Bamburg et al. | 222/528 |
| 4,043,502 | 8/1977 | Croley | 229/122 |
| 4,186,866 | 2/1980 | Zicko | 229/122.1 |
| 4,361,250 | 11/1982 | Foster | 220/226 |
| 4,548,351 | 10/1985 | Gusic | 229/122.1 |

FOREIGN PATENT DOCUMENTS

| | | | |
|---|---|---|---|
| 664125 | 5/1963 | Canada | 229/23 R |
| 2635107 | 2/1977 | Fed. Rep. of Germany | 222/528 |

*Primary Examiner*—Gary E. Elkins

*Attorney, Agent, or Firm*—Charles E. Temko

[57] ABSTRACT

An improved collapsible container for shipping and dispensing particulate and similar material in industrial locations. The container includes a liner member in juxtaposed relation to the inner surfaces of the container, the container and liner member each including a front wall having a lined rectangular opening, each opening forming a full fold line at an upper edge thereof, and hook and pile fastening means for retaining first and second flaps formed by said aligned openings in opened condition to permit discharge of contents. When in closed condition, the flaps lie in the planes of the respective walls of the container and liner member. A laterally extending closure member is mounted on the first flap and provides means for maintaining the first flap in closed position by engaging an outer surface of the container.

3 Claims, 2 Drawing Sheets

COLLAPSIBLE CONTAINER HAVING CONGRUENT DOOR RETAINING MEANS

BACKGROUND OF THE INVENTION

This invention relates generally to the field of collapsible containers of the type disclosed in my prior U.S. Pat. No. 4,572,408 granted Feb. 25, 1986; and more particularly to an improved version thereof particularly adapted for use with tilting support structure facilitating the discharge of particulate contents.

In the above patent there is disclosed a collapsible container having a side wall forming a through opening. A collapsible spout is positioned within the opening which folds into the plane of the side wall, in which condition upper and lower flaps overlie the spout, the flaps being maintained in this position by a transversely extending cover having openings at the lateral ends thereof for engagement with clip means which also engage corresponding openings in the side wall. This structure has been particularly useful in locations where the container is supported on a horizontal surface and a spout is necessary to control flow of the contents through the opening.

In relatively sophisticated industrial locations, it is known in the art to employ tilting support stands which engage metal tote containers having hinged cover members in a side wall at a location adjacent a bottom wall, which cover members selectively permit access to the interior of the container, and the puncturing of a bag-like inner sack disposed therein to permit the contents thereof to flow through the opening. Because of the nature of the tilt stand which may incorporate chute structure, no spout positioned in the opening is necessary.

However, metal tote containers are relatively large, heavy, expensive to manufacture, and are non-collapsible for return to a refilling source. They are relatively cumbersome, and because of downwardly projecting integral leg structure mounted on a lower surface thereof, they are not normally stackable in loaded condition without resultant damage.

SUMMARY OF THE INVENTION

Briefly stated, the invention contemplates the provision of an improved form of the structure disclosed in my above-mentioned patent which is particularly adapted for use with known tilt support structure in which the closure components have been provided with means for selectively mounting the closure flaps in overlying opened condition during use to maintain a clear opening for continuous flow without resort to a spout. This is accomplished by providing a hinged fold line in each of two juxtaposed inner and outer side walls supporting overlying flaps, each flap being supported on an upper transverse edge. Hook and pile interconnecting means interconnects an inner flap to a surface of an outer flap positioned therebeneath. Separate hook and pile means interconnects the outer flap to an outer surface of a respective side wall. When in closed condition, the flaps are substantially congruent, each within the plane of a respective inner and outer side wall. A separate retaining member is secured to the outer flap, the member having openings at the laterally extending end portions thereof for engagement by expandable clips in known manner which clips also engage the outer side wall. The disclosed embodiment is formed of fibrous material, and is capable of being collapsed for return shipment after use.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
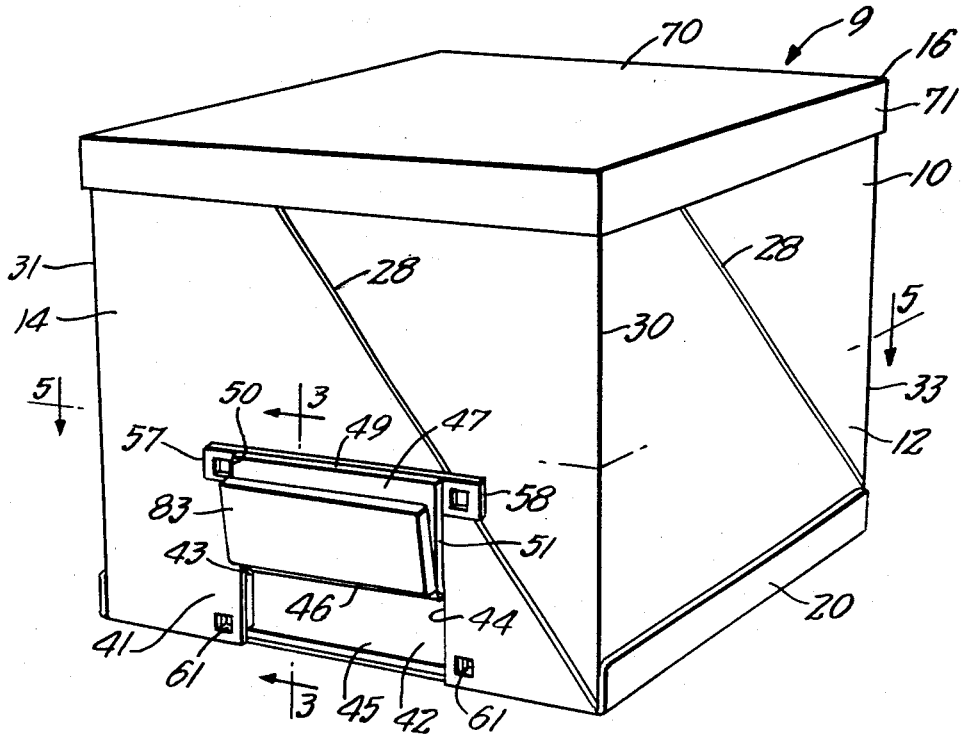
FIG. 1 is a front perspective view of an embodiment of the invention showing the device in fully opened condition.

In accordance with the invention, the device, generally indicated by reference character 9 includes a collapsible container 10 of fibrous material, the container having a bottom wall 11, side walls 12 and 13, a front wall 14, a rear wall 15, a removable cover 16 and a liner member 17.

The bottom wall 11 may be of composite type, and may be formed integrally with a known "slipsheet" having a peripheral flap 20 along one edge thereof to facilitate engagement by a fork lift truck. Alternatively, it can be provided with a wooden or synthetic resinous pallet (not shown) also known in the art.

The side walls 12 and 13 are generally conventional, and are preferably provided with known diagonally positioned score lines 28 to permit folding of the container for return shipment when emptied. The side walls are interconnected with the front wall 14 and rear wall 15 at vertical corner edges 30, 31, 32 and 33, to form a continuous lower edge 34 and a continuous upper edge 35.

The front wall 14 at a lower central area 41 forms a rectangular opening 42 bounded by side edges 43 and 44, a lower edge 45 and an upper fold edge 46 which supports a first integral closure flap 47. The flap is bounded by a lower edge 49, and side edges 50 and 51. Secured to an outer surface 53 is an elongate closure member 54 bounded by laterally extending edges 55 and 56 and end edges 57 and 58. Adjacent the end edges 57–58 are a pair of rectangular openings 59 selectively engageable by expandable clips (not shown) which also engage corresponding openings 61 in the front wall 14. When so engaged, the container is maintained in substantially sealed condition for shipment. The outer surface 63 of the first flap 47 is provided with hook and pile members 64 selectively engageable with corresponding member 65 on the outer surface 66 of the front wall, which engagement serves to maintain the flap 47 in fully open condition.

The cover 16 is of conventional construction, including a main wall 70 bordered by a peripheral wall 71. It is adapted to engage the upper edge 35 to maintain the container in closed condition, and may be removed for purposes of loading.

The liner member 17 is of generally conventional construction. It is made of heavier material than the container, and serves to reinforce the container once it is positioned in juxtaposed relation within the cavity formed by the walls 11–15, inclusive. The liner member includes a front wall 76, side walls 77 and 78 and a rear wall 79. While the container will normally be formed of two ply corrugated material, the liner member may be formed of three to five ply material.

The front wall 76 of the liner member at a lower area 81 forms a corresponding opening 82 aligned with the opening 42. It mounts a second corresponding flap 83 formed to include first and second portions 84 and 85 which together close the opening 82. The second flap 83 includes a hinge portion 86 and a main flap portion 87 formed by partially severing the material comprising the flap to form fold lines. The main flap 87 includes an outer surface 88 and an inner surface 89. The outer surface 88 is provided with hook and pile interconnecting members 90 which selectively engage corresponding members 91 on the inner surface 92 of the first flap 47. The second portion 84 includes a bridging surface 94 which overlies the abutted upper edges of the aligned openings in the container and liner member, thus facilitating particulate flow.

Placing the device in use will be readily understood from a consideration of the drawings. Once the container has been engaged with a tilt support, the front wall will normally be inclined at an angle with respect to the vertical, so that the contents of the container may be discharged under the action of gravity with or without the assistance of compressed air.

Figure 2:
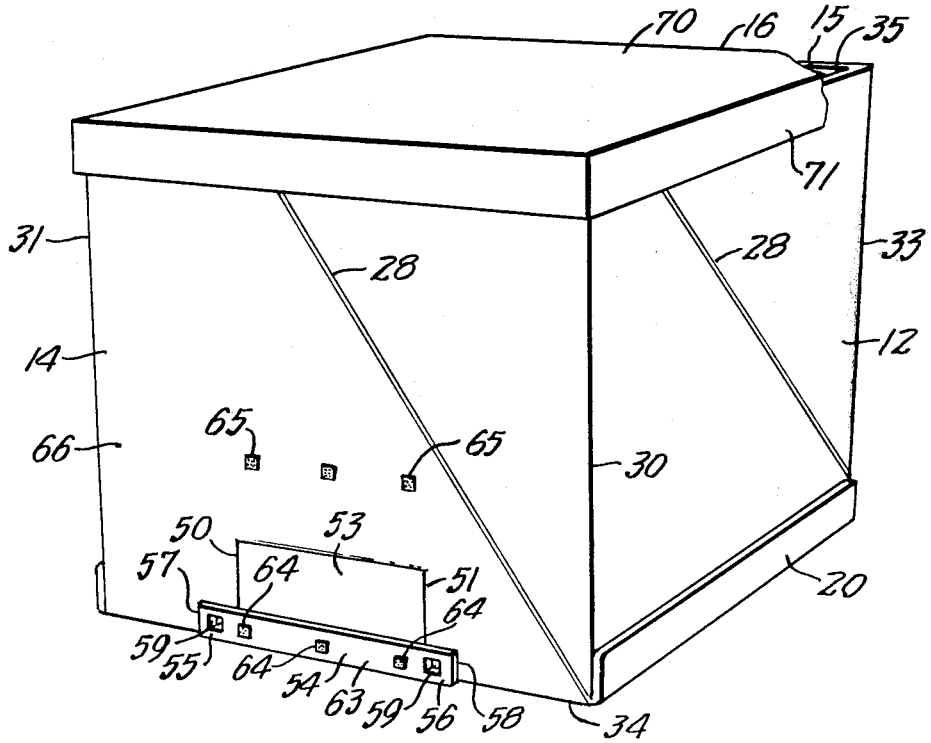
FIG. 2 is a front perspective view thereof showing the device in fully closed condition.
Figure 3:
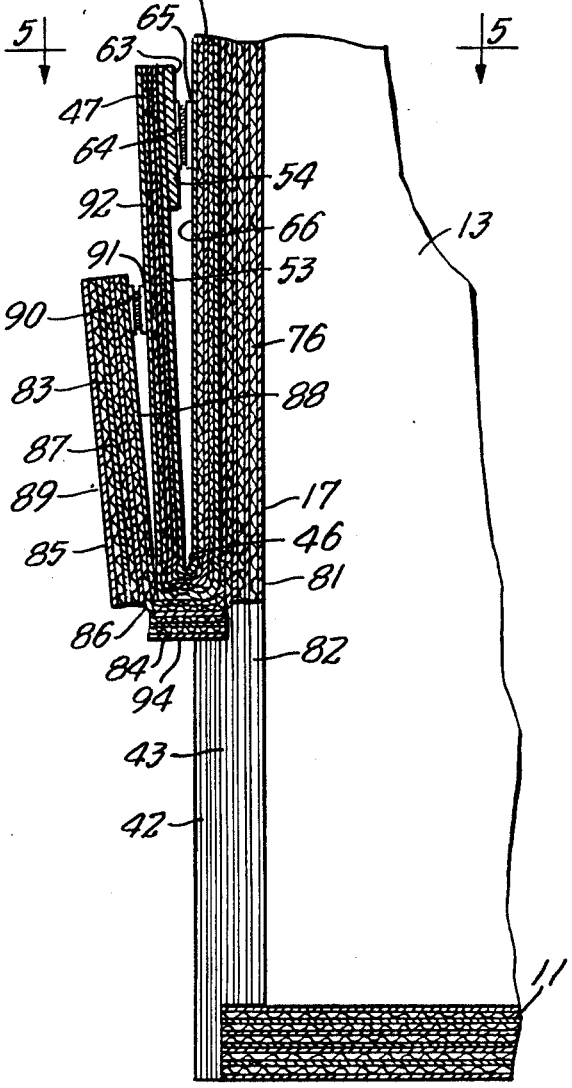
FIG. 3 is an enlarged fragmentary vertical sectional view as seen from the plane 3—3 in FIG. 1.
Figure 5:
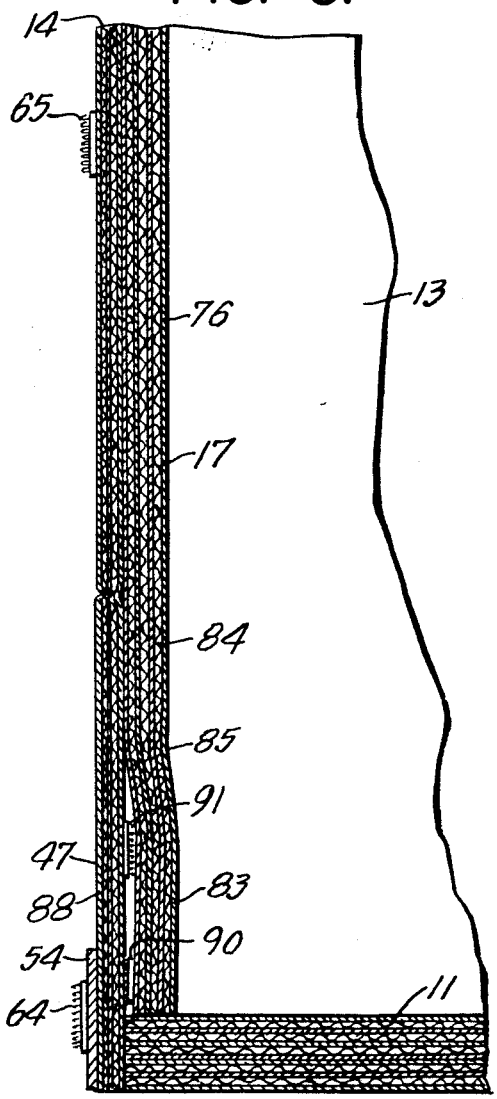
FIG. 5 is a fragmentary sectional view corresponding to that seen in FIG. 3, but showing the device in closed condition.
Figure 4:
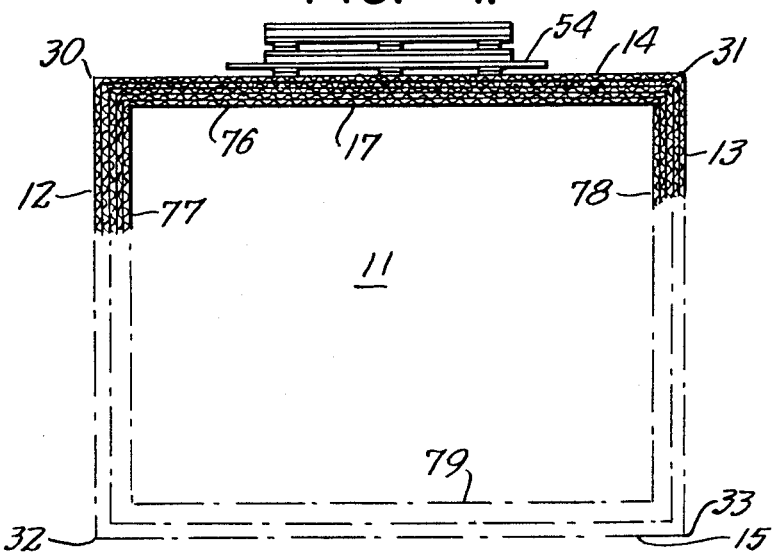
FIG. 4 is a top plan view thereof with a cover element removed.

Assuming that the container does not show evidence of tampering, the closure member 54 is disengaged, permitting the first flap to be swung about its upper horizontal edge to the position shown in FIG. 3 wherein the hook and pile members on the closure member engage the corresponding members on the outer surface of the front wall. Next the second flap member is engaged and pivoted in a similar manner to a point where the hook and pile members on the outer surface thereof engage the corresponding members on the inner surface of the first flap wherein the device assumes the condition shown in FIG. 3. If the contents are disposed within a rupturable synthetic resinous bag (not shown), this bag may be cut to form a flow opening, and flow the particulate material therethrough and continue until the container has been emptied. Prior to collapsing the device for return shipment, the respective hook and pile means are disengaged and the flaps are returned to co-planar relation relative to the walls with which they are integrally formed, and the closure member 54 may be again re-engaged in the condition shown in FIG. 2. The cover element 16 may then be removed, the liner member 17 removed and folded to planar condition, and the side walls of the container may then be collapsed in known manner upon the bottom wall 11. The now collapsed liner member may be superimposed thereupon, and the cover element repositioned to completely enclose the now collapsed members. In this condition, the collapsed container and liner member will occupy a height not exceeding the height of the peripheral wall 71.

As contrasted with the construction disclosed in my prior patent, because of the use of hook and pile fasteners on the respective parts, the presence of a collapsible spout is not necessary, and the interconnection of the first and second flaps in opened conditions serves to reinforce the loaded container in those areas in which reinforcement is most needed. Aside from the provision of hook and pile fastener members, the device is constructed entirely of fibrous materials with resultant low cost of manufacture, and, at least as important, relatively low total weight as contrasted with corresponding metal containers.

I wish it to be understood that I do not consider the invention to be limited to the precise details of structure shown and set forth in this specification, for obvious modifications will occur to those skilled in the art to which the invention pertains.

I claim:

1. In a collapsible fibrous container for use in transporting and dispensing particulate and similar material, the container having vertical front, rear and side walls and a bottom wall interconnected to form a rectangular enclosure, a liner member including front, side and rear walls and positioned in abutted relation to said container within said enclosure, there being a through opening in said front wall of said liner and said container adjacent said bottom wall, the improvement comprising: said front wall of said container having a first integral closure flap hingedly connected by a fold line at an upper edge thereof, said first flap having inner and outer surfaces and hook and pile interconnecting means on each of said inner and outer surfaces; said front wall of said liner member having a second flap thereon in generally congruent relation relative to said first flap, said second flap having hook and pile means on an outer surface thereof selectively engageable with said hook and pile means on said inner surface of said first flap; said first flap having a laterally extending elongated closure member secured to said outer surface of said first flap, said closure member having means for selectively securing said closure member to an outer surface of said front wall of said container, thereby maintaining said first flap in closed condition; said last mentioned outer surface having hook and pile means thereon selectively engageable with hook and pile means on said outer surface of said first flap to maintain said flap in opened condition; whereby upon the opening of said container for discharge of the contents thereof, said closure member is first disengaged from said outer surface of said front wall of said container, and said first flap is pivoted into contact with said front wall, said second flap being subsequently pivoted to engage said first flap to form a clear passage in said through opening.

2. The improvement set forth in claim 1, is further characterized in said second flap being formed to include a hinge member of width corresponding to the depth of said through opening, and a flap member interconnected to said hinge member at a fold line.

3. The improvement set forth in claim 2, further characterized in said hook and pile members of said outer surface of said second flap and said hook and pile members on said inner surface of said first flap being in disaligned relation when said flaps are in closed condition.

* * * * *